US006454328B1

(12) United States Patent
Barillos

(10) Patent No.: US 6,454,328 B1
(45) Date of Patent: Sep. 24, 2002

(54) COMPACT CHOPSTICK

(76) Inventor: Paul M. Barillos, 852 Lorette Avenue, Winnipeg, Manitoba (CA), R3M 1T4

( * ) Notice: Subject to any disclaimer, the term of this patent is extended or adjusted under 35 U.S.C. 154(b) by 0 days.

(21) Appl. No.: 09/953,621

(22) Filed: Sep. 17, 2001

(51) Int. Cl.[7] ..... A47G 21/10; A47J 43/28
(52) U.S. Cl. ..... 294/16; 294/99.2
(58) Field of Search ..... 294/3, 8, 8.5, 11, 294/16, 28, 33, 50.8, 50.9, 99.2, 104, 106; 30/142, 147, 150, 322; D7/643, 683, 686

(56) References Cited

U.S. PATENT DOCUMENTS

| | | | | | |
|---|---|---|---|---|---|
| 2,350,528 | A | * | 6/1944 | Petersen | 294/8.5 |
| 2,647,006 | A | * | 7/1953 | Coyle | 294/8.5 |
| 3,323,825 | A | * | 6/1967 | Arima | 294/99.2 |
| 3,414,310 | A | * | 12/1968 | Ono | 294/16 |
| 6,217,092 | B1 | * | 4/2001 | Spicker | 294/16 |

* cited by examiner

*Primary Examiner*—Johnny D. Cherry
(74) *Attorney, Agent, or Firm*—M. K. Silverman

(57) ABSTRACT

A compact and convenient chopstick system includes a first elongate member having a proximal end and a distal food engagement end, the member further having an outer lateral surface and an inner lateral surface comprising engagement means at the distal end. At the proximal end of the inner surface is a male journal surface including a transverse pivot channel and a transverse rotation-limit surface, and a U-shaped channel within a distal side of the journal surface of the inner lateral surface. The utensil further includes a second elongate member having a proximal end and a distal food engagement end, the member further having an outer surface and an inner surface comprising engagement means at the distal end and a female journal surface, complemental to the male journal surface of the first elongate member, including a transverse pivot channel co-linear with the channel of the male surface, and a transverse rotation limit surface complemental to the rotational limit surface of the first elongate member. The second member also includes a U-shaped channel within a distal side of the journal surface of the inner surface of the second elongate member.

10 Claims, 5 Drawing Sheets

COMPACT CHOPSTICK

BACKGROUND OF THE INVENTION

1. Area of Invention

This invention relates to eating utensils and, more particularly, an improvement in the Chinese chopstick system.

2. Prior Art

As is well known, chopsticks are elongated elements having a length of about 10 to about 40 cm and a diameter between about 0.5 and 0.8 centimeters. Chopsticks have been used for thousand of years in the Orient as a primary utensil employed to grasp various types and consistencies of solid food to effect the eating thereof. As such, the chopstick has served as the Oriental equivalent of the western fork for dozens of centuries.

In modern times, many westerners have attempted to master the use of chopsticks so that, upon certain occasions, when eating in a Chinese, Japanese or Thai restaurant, they are able to eat such food in the same manner as it has historically been eaten in the Orient. However, proficiency in the use of chopsticks has proven most difficult for many to acquire. Also, many people in the Orient do not feel that the historical or classical chopstick pair is today a viable equivalent of the western fork, given the considerable range of types and consistencies of foods which in modern times have been introduced from abroad.

Accordingly, a need has arisen, for both westerners and others, for an improvement of the traditional chopstick system on a basis that would not be culturally or otherwise offensive to people of the Orient and which, as well, would be easier for westerners to utilize than the traditional pair of chop-sticks. It is as a response to such needs that the present invention is directed.

The inventor is aware of efforts in the prior art to provide interconnected chopsticks to render the same easier to use. Such efforts are reflected in U.S. Pat. No. 4,973,095 (1990) to Kunihisa, entitled Interconnected Chopstick, and U.S. Pat. No. 5,697,659 (1997) to Calagui, entitled Eating Utensil. The instant invention may thereby be viewed as an improvement over such prior art.

SUMMARY OF THE INVENTION

The instant invention relates to a compact and convenient chopstick system comprising a first elongate member having a proximal end and a distal food engagement end, said member further having an outer lateral surface and an inner lateral surface comprising engagement means at said distal end. At said proximal end of said inner surface is a male journal surface including a transverse pivot channel and a transverse rotation-limit surface, and a U-shaped channel within a distal side of said journal surface of said inner lateral surface. The utensil further includes a second elongate member having a proximal end and a distal food engagement end, said member further having an outer surface and an inner surface comprising engagement means at said distal end and a female journal surface, complemental to said male journal surface of said first elongate member, including a transverse pivot channel co-linear with said channel of said male surface, and a transverse rotation limit surface complemental to said rotational limit surface of said first elongate member. The second member also includes a U-shaped channel within a distal side of said journal surface of said inner surface of the second elongate member. The novel utensil also includes an axle secured within said pivot channel to thereby pivotally join the first and second members. Further included is a reed spring spanning and secured within both of said U-shaped channels to thereby stabilize said elongate members and to provide a normally outward bias relative to each other. Said elongate members preferably pivot upon a radius of about one centimeter on said journal surfaces across a range of rotation of 10 to 15 degrees. The utensil exhibits a ratio of greatest length to greatest width, when in a compressed mode, of about 3:1.

In view of the above, it is an object of the instant invention to provide an improvement of the traditional chopstick system.

It is another object to provide an eating utensil that may be employed as substitute for the historical Oriental chopstick pair.

It is a further object of the invention to provide a chopstick system more readily usable within western foods.

It is a yet further object to provide an eating utensil that may be utilized as a substitute for the western fork.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

Figure 1:
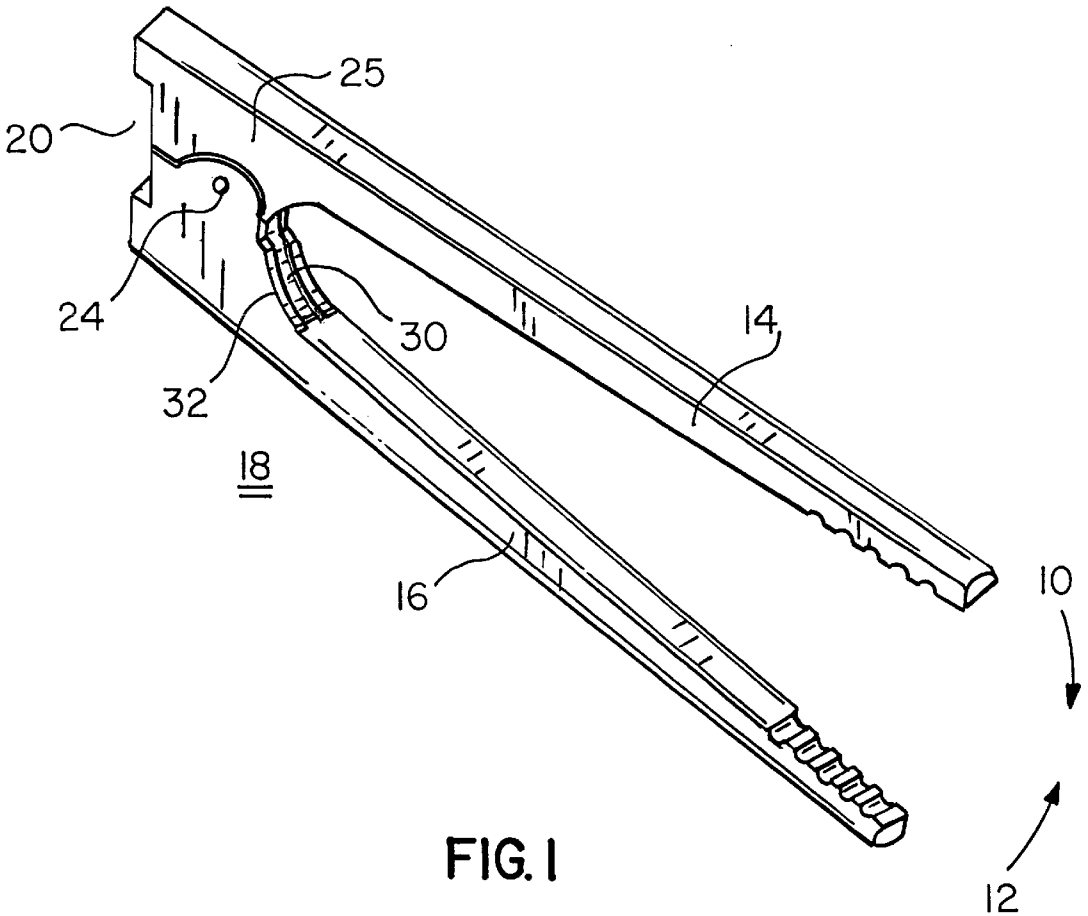
FIG. 1 is a perspective view of the inventive compact chopstick in an open position.
Figure 1A:
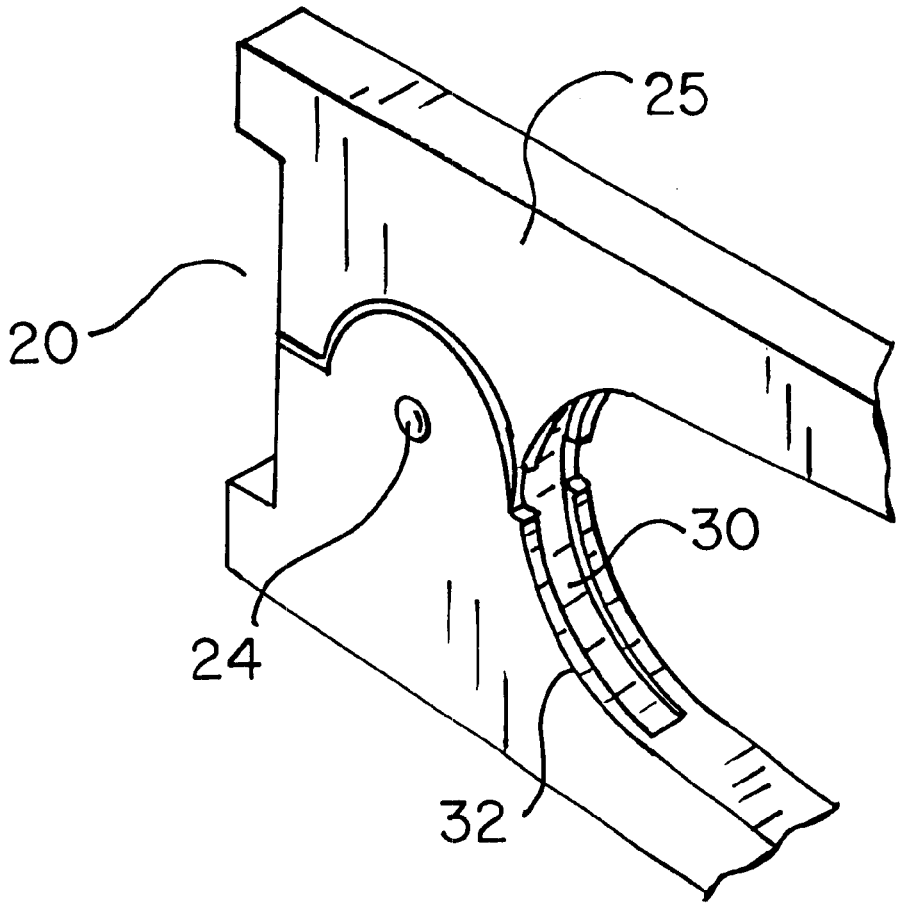
FIG. 1A is an enlargement of the reed spring element of the invention and its environment.

With reference to the perspective operational view of FIG. 1, arrows 10 and 12 represent movement in the direction of closure or engagement, about an axle 24, of elongate members 14 and 16, of the inventive compact chopstick 18. Each of these members has enlarged proximal portions 25 and 28 respectively. Portion 28 is also a journal surface, as noted below, which limits angular rotation of the members 14 and 16 relative to each other.

Figure 3:
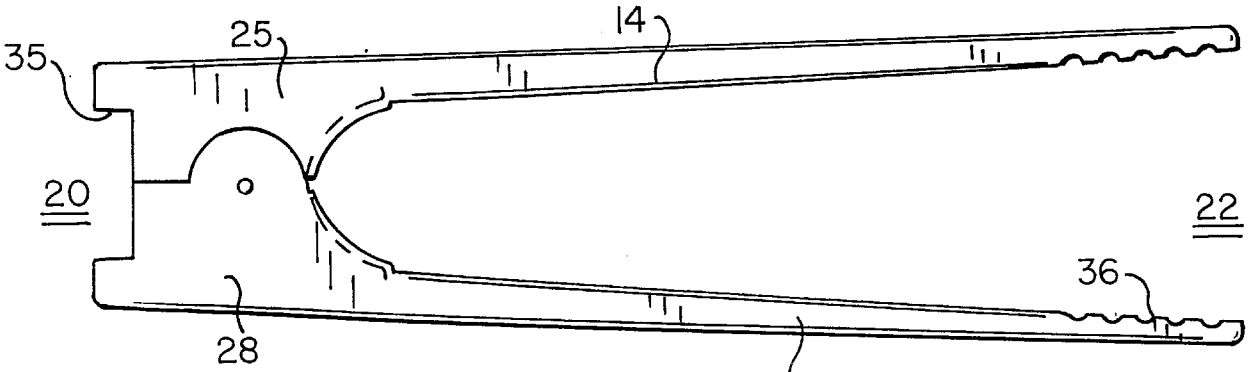
FIG. 3 is a side elevational view of the utensil of FIG. 1.
Figure 5:
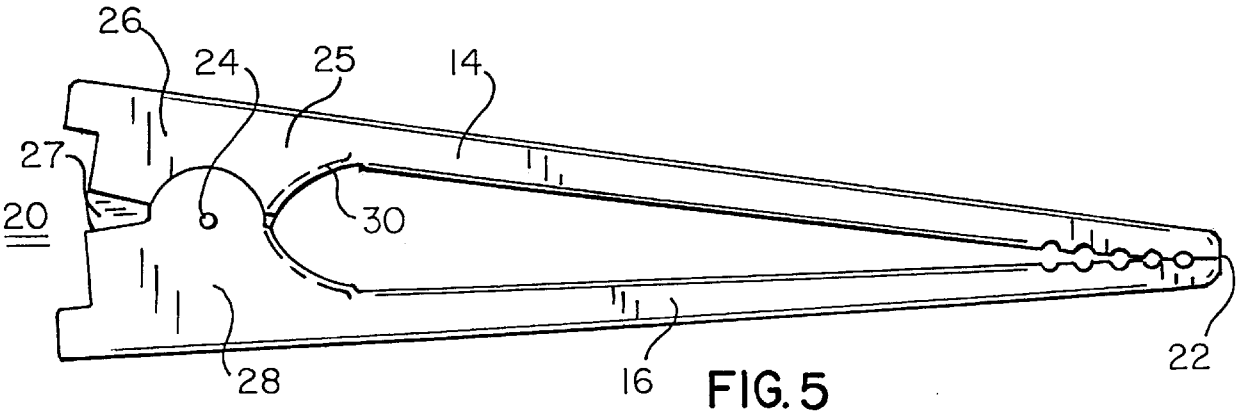
FIG. 5 is a side elevational view showing use of the utensil in a closed position.

FIGS. 3 and 5 show the utensil in respective open and closed positions.

Figure 2:
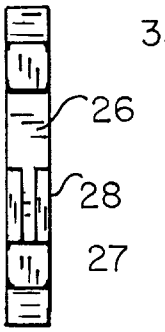
FIG. 2 is a left or proximal end view of the utensil shown in FIG. 1.
Figure 4:
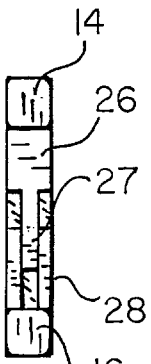
FIG. 4 is a left or proximal end view of the compact chopstick system when in a closed or food engagement position.
Figure 6:
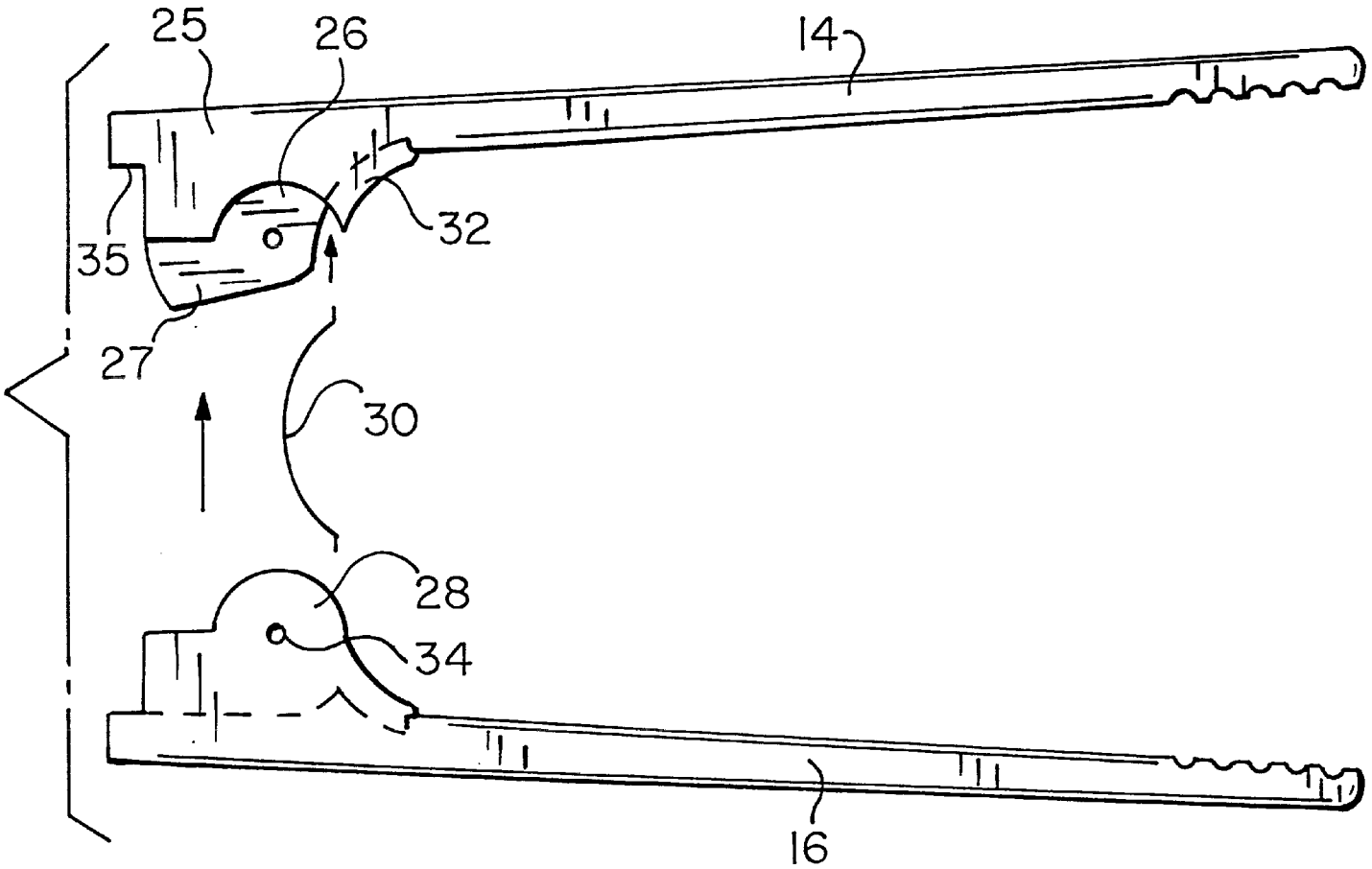
FIG. 6 is an exploded view of the utensil of the utensil.

The utensil is characterized by a proximal end 20 and distal end 22. It is further characterized by a pivot axle 24 upon which said first and second elongate members 14 and 16 respectively are pivoted. Engagement therebetween is facilitated by a journal surface 26 and said proximal portion 28 (see FIGS. 5 and 6) of the elongate members 14 and 16 respectively, this inclusive of male extension 27 (of surface 26) which mates with female surface 28. See FIGS. 2, 4, 5 and 7. The nature of this engagement of said surfaces may be more fully appreciated in the proximal end views of FIGS. 2 and 4. These surfaces define a radius of rotation of about one centimeter and an angle of rotation of about 12.5 degrees by male extension 27 about pivot axle 24. The interdigitation of said journal surfaces, taken in combination with reed spring 30, located within U-shaped channels 32 (see FIGS. 1 and 6), of the elongate members, act to stabilize the members relative to each other, and to provide a normally outward ergonomic bias relative thereto. This bias is of course overcome when manual pressure by the hands and fingers of a user, in the direction of arrows 10 and 12 (see FIG. 1), is applied to said elongate members 14 and 16. It should be appreciated that other biasing means, for example, a spiral loop spring, may be employed to achieve such outward bias.

Figure 7:
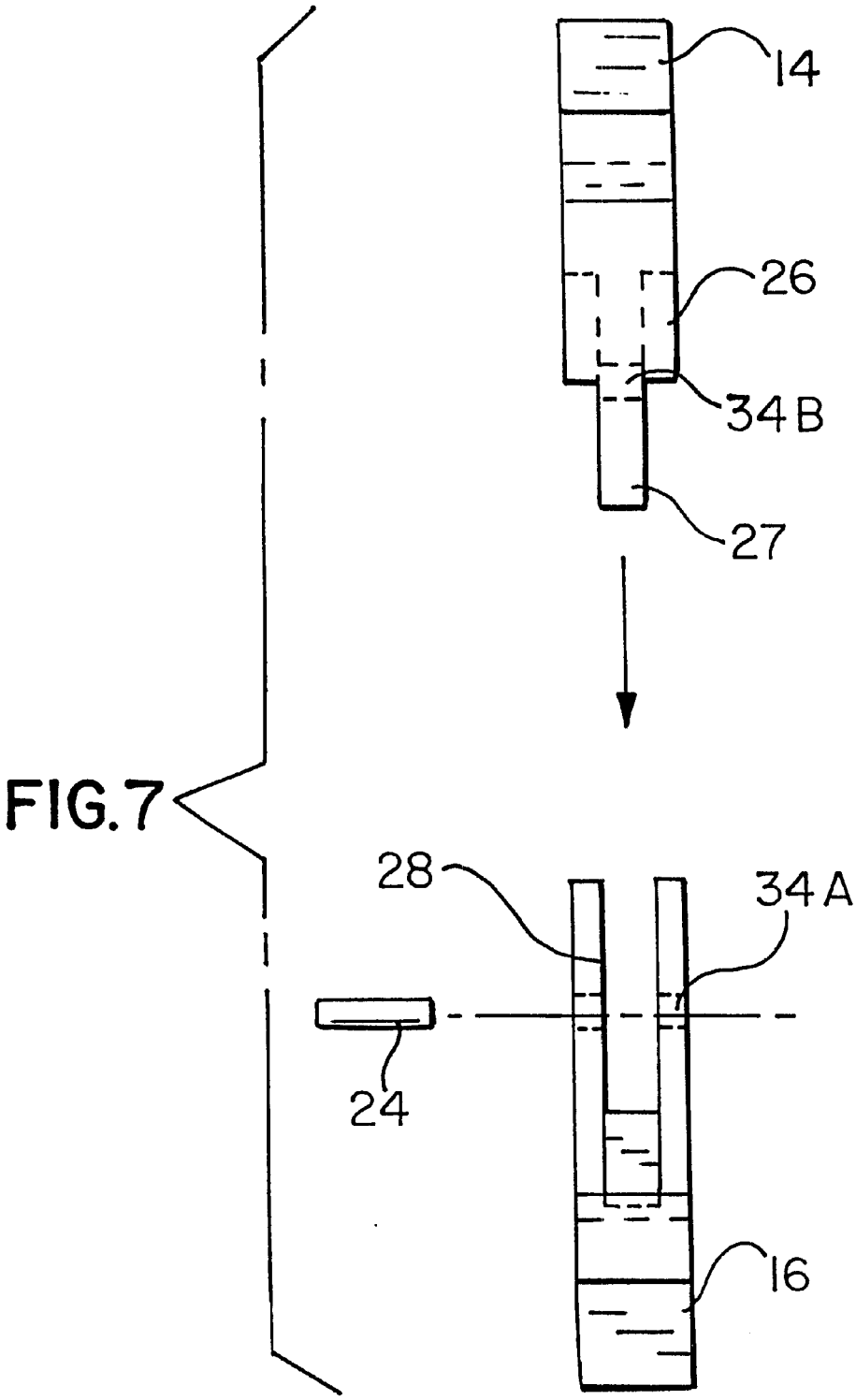
FIG. 7 is a proximal exploded end view showing the pivotal relationship between complemental transverse rotation limit surfaces of the respective elongate members.

In the rear exploded view of FIG. 7 is shown axle 24 as well as an axle channel formed by holes 34A within rotation limit surface 28, and hole 34B within male rotation limit extension 27 of elongate member 14.

It has been found that the present utensil is optimally ergonomic when a ratio of about three-to-one exists between the length of each of the elongate members 14 and 16 and the greatest dimension of proximal end 20 when measured transversely at pivot axle 24. Also, the slip fit mesh between extension 27 and female surface 28 contributes to the stability and ergonomics of the resultant utensil as does said limit of 12.5 degrees of the extent of rotation of one member relative to another. This angle may however fall within a range of 10 to 15 degrees.

Accordingly, as significant as the mechanics of the present system is the discovery that certain dimensional relationships, as above described, are optimal for a practical chopstick system capable of performing the function of traditional chopsticks. Therein, a typical length of each of the elongate members 14 and 16 is about 10 to 20 centimeters while that of the corresponding transverse dimension of proximal end 20 of the utensil is preferably in the range of five to six centimeters when measured through pivot point 24 and when said members 14 and 16 are parallel. It has been further found that a C-shaped surface 35 of proximal end 20 (see FIG. 3) assists in stabilizing the utensil within the hand of the user. At distal ends 22 are provided serrated surfaces 36 which enhance engagement of food by the elongate members 14 and 16.

The inventive utensil may be cost-effectively manufactured from a wide range of hygienic thermoplastics such as polystyrenes and polycarbonates and as may be appreciated, requires only four pieces for the production thereof, namely, first elongate member 14, second elongate member 16, axle 24 and reed spring 30.

While there has been shown and described the preferred embodiment of the instant invention, it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

Having described my invention what I claim as new, useful and non-obvious and accordingly, secured by Letters Patent of the United States is:

1. A utensil for a compact chopstick system comprising:

(a) a first elongate member having a proximal end and a distal food engagement end, said member further having an outer lateral surface and an inner lateral surface comprising:

(i) engagement means at said distal end (ii) at said proximal end, a male journal surface including a transverse pivot channel, and a transverse rotation limit surface; and (iii) a U-shaped channel within a distal side of said male journal surface;

(b) a second elongate member having a proximal end and a distal food engagement end, said second member further having an outer lateral surface and an inner lateral surface comprising:

(i) engagement means at said distal end;

(ii) at said proximal end a female journal surface, complemetal to said male journal surface of said first elongate member, including a transverse pivot channel, co-linear with said pivot channel of said male journal surface, and having a transverse rotation limit surface therein complemental to said rotation limit surface of said male journal surface; and (iii) a U-shaped channel within a distal side of said female journal surface;

(c) an axle secured within said pivot channels to thereby pivotally join said first and second members; and (d) outward biasing means spanning and secured within both of said u-shaped channels to thereby stabilize said elongate members relative to each other and to also provide a normally outward bias relative to each other to thereby provide an ergonomic response when the members are engaged by the human hand as said members pivot about said axle.

2. The utensil as recited in claim 1 in which said proximal ends of each of said elongate members define a C-shaped stabilizing surface at proximal-most end surfaces thereof.

3. The utensil as recited in claim 2 in which a length of each of said elongate members comprises a range of about 10 to about 20 centimeters.

4. The utensil as recited in claim 3 in which said biasing means comprises a reed spring.

5. The utensil as recited in claim 3 in which said axle and journal surfaces define a radius of rotation of about one centimeter.

6. The utensil as recited in claim 5 in which said axle and journal surfaces define an extent of rotation of between 10 and 15 degrees.

7. The utensil as recited in claim 3 in which said axle and journal surfaces define an extent of rotation of between 10 and 15 degrees.

8. The utensil as recited in claim 7 in which a ratio of about 3:1 exists between the length each of said elongate members, when parallel to each other, and the transverse width of said proximal end when measured through said pivot axle.

9. The utensil as recited in claim 3 in which a ratio of about 3:1 exists between the length each of said elongate members, when parallel to each other, and the transverse width of said proximal end when measured through said pivot axle.

10. The utensil as recited in claim 1 in which said axle and journal surfaces define a radius of rotation of about one centimeter.

* * * * *